US007331537B2

(12) United States Patent
Kuegler et al.

(10) Patent No.: US 7,331,537 B2
(45) Date of Patent: Feb. 19, 2008

(54) FUEL INJECTION VALVE FOR INTERNAL COMBUSTION ENGINES

(75) Inventors: Thomas Kuegler, Korntal-Muenchingen (DE); Jochen Mertens, Reutlingen (DE); Hasiman Ueskuedar, Bursa (TR)

(73) Assignee: Robert Bosch GmbH, Stuttgart (DE)

( * ) Notice: Subject to any disclaimer, the term of this patent is extended or adjusted under 35 U.S.C. 154(b) by 20 days.

(21) Appl. No.: 10/533,635

(22) PCT Filed: Oct. 27, 2003

(86) PCT No.: PCT/DE03/03561

§ 371 (c)(1),
(2), (4) Date: May 2, 2005

(87) PCT Pub. No.: WO2004/044414

PCT Pub. Date: May 27, 2004

(65) Prior Publication Data

US 2006/0011749 A1 Jan. 19, 2006

(30) Foreign Application Priority Data

Nov. 11, 2002 (DE) ..... 102 52 660
Apr. 7, 2003 (DE) ..... 103 15 820

(51) Int. Cl.

| | |
|---|---|
| ***F02M 61/10*** | (2006.01) |
| ***F02M 47/02*** | (2006.01) |
| ***F02M 63/00*** | (2006.01) |
| ***F02M 61/00*** | (2006.01) |
| ***F02M 51/00*** | (2006.01) |

(52) U.S. Cl. ..... 239/533.11; 239/88; 239/533.2; 239/533.3; 239/585.5

(58) Field of Classification Search ..... 239/533.11, 239/88, 533.2, 533.3, 585.5, 89–96, 533.8, 239/533.9, 533.12, 533.13, 584
See application file for complete search history.

(56) References Cited

U.S. PATENT DOCUMENTS

| | | | |
|---|---|---|---|
| 1,834,061 | A | 12/1931 | Joachim |
| 4,151,958 | A | 5/1979 | Hofmann |
| 4,202,500 | A | 5/1980 | Keiczek |
| 5,199,398 | A | 4/1993 | Nylund |

(Continued)

FOREIGN PATENT DOCUMENTS

| | | |
|---|---|---|
| DE | 19834867 | 11/1999 |

(Continued)

*Primary Examiner*—Darren Gorman
(74) *Attorney, Agent, or Firm*—Michael J. Striker

(57) ABSTRACT

A fuel injection valve for internal combustion engines, having a valve body (1) in which a bore (3) is embodied that is defined on its end toward the combustion chamber by a valve seat (18) at which at least one injection opening (20) originates. The hollow valve needle (8) is located longitudinally displaceably in the bore (3) and has a valve sealing face (35) on its end oriented toward the valve seat (18). A first sealing region (31; 34) and a second sealing region (32; 46; 48) are embodied on the valve sealing face (35), and upon contact of the hollow valve needle (8) with the valve seat (18), the first sealing region (31; 34) upstream of the at least one injection opening (20) and the second sealing region (32; 46; 48) downstream of that injection opening effect sealing between the valve sealing face (35) and the valve seat (18) (FIG. 1).

3 Claims, 8 Drawing Sheets

U.S. PATENT DOCUMENTS

| | | | | |
|---|---|---|---|---|
| 5,899,389 | A * | 5/1999 | Pataki et al. | 239/533.2 |
| 6,024,297 | A * | 2/2000 | Greeves | 239/96 |
| 6,338,445 | B1 * | 1/2002 | Lambert et al. | 239/533.12 |
| 6,378,503 | B1 * | 4/2002 | Lambert | 123/468 |
| 6,892,965 | B2 * | 5/2005 | Haeberer et al. | 239/533.12 |
| 2001/0054656 | A1 | 12/2001 | Ricco | |
| 2003/0094517 | A1 * | 5/2003 | Kato et al. | 239/585.1 |
| 2004/0055562 | A1 * | 3/2004 | Stewart et al. | 123/299 |
| 2004/0232256 | A1 * | 11/2004 | Winter et al. | 239/88 |

FOREIGN PATENT DOCUMENTS

| | | |
|---|---|---|
| DE | 100 58 153 | 6/2002 |
| DE | 101 55 227 | 5/2003 |
| EP | 0 470 348 A1 | 1/1992 |
| EP | 0470348 | 12/1992 |
| EP | 0520659 | 12/1992 |
| EP | 1063417 | 12/2000 |
| EP | 1136693 | 3/2001 |
| FR | 2 328 855 | 5/1977 |
| WO | 03040543 | 5/2003 |

* cited by examiner

FUEL INJECTION VALVE FOR INTERNAL COMBUSTION ENGINES

PRIOR ART

The invention is based on a fuel injection valve for internal combustion engines, of the kind known for instance from German Patent Disclosure DE 100 58 153 A1. A fuel injection valve of this kind has a valve body in which there is a bore that is defined on its end toward the combustion chamber by a valve seat. A pistonlike hollow valve needle is located in the bore and on its toward the combustion chamber, that is, oriented toward the valve seat, it has a valve sealing face with which it cooperates with the valve seat. As a result, at least one injection opening that originates at the valve seat and, in the installed position of the fuel injection valve, discharges into the combustion chamber of the engine, is opened and closed.

The fuel is typically kept on hand in a pressure chamber that is embodied between the valve needle and the wall of the bore. In the pressure chamber, at least during the injection event, a high pressure prevails, so that good atomization of the fuel is attained, which is indispensable for effective, low-pollutant combustion. Between injections, the injection openings must be sealed off, however, so that no fuel can reach the combustion chamber uncontrolled, which would lead to increased pollutant emissions. Moreover, there is otherwise the risk of so-called blowback, in which combustion gases from the combustion chamber enter through the injection openings into the injection valve, where they alter the situation such that the next injection event cannot proceed optimally. For instance, too little fuel is then injected, which is expressed by a power drop. Moreover, the instant of injection can shift, leading to rough running and increased pollutant emissions from the engine.

ADVANTAGES OF THE INVENTION

The fuel injection valve of the invention having the definitive characteristics of claim 1 has the advantage over the prior art that the injection openings are sealed off in the intervals between injections. To that end, on its valve sealing face, the hollow valve needle has two sealing regions; the first sealing region effects sealing between the valve sealing face and the valve seat upstream, and the second sealing region effects the sealing downstream, of the at least one injection opening. The entrance to the injection openings is sealed off by both sealing regions, so that fuel cannot reach the combustion chamber uncontrolled, nor can combustion gases from the combustion chamber enter the fuel injection valve via the injection openings.

Advantageous features of the subject of the invention are possible by means of the dependent claims.

In a first advantageous features, the first sealing region is embodied as a conical face. The result is a flat contact with the valve seat, which reduces the pressure per unit of surface area there and thus reduces the mechanical stress. The second sealing region can be embodied in this way as well.

If the seal is to withstand high pressures, the sealing regions can be embodied by edges. To that end, the first sealing region is embodied at the transition from a first conical face to a second conical face, and the conical faces form part of the valve sealing face. The second sealing region may also be embodied by an edge, preferably by providing a third conical face on the valve sealing face, between which third conical face and the second conical face an annular groove is embodied. At the transition from the annular groove to the third conical face, the latter having a larger opening angle than the conical valve seat, an edge is then created that forms the second sealing region. Instead of an annular groove, it can also be provided that between two conical faces, two further conical faces are embodied, which are inclined such that they create an annular groove-like recess that covers the injection openings. Such an embodiment is easier to manufacture than a rounded annular groove, since one and the same tool can be used for all the conical faces.

It is especially advantageous if the second sealing region, which is located downstream of the first sealing region, takes its seat on the valve seat upon the closing motion of the valve needle before the first sealing region does. As a result, the downstream end, toward the combustion chamber, of the hollow valve needle, once the second sealing region has become seated on the valve sealing face, must deform elastically somewhat inward, which then makes it possible for the first sealing region to take its seat. The result is a high pressure per unit of surface area in both the first and the second sealing region and thus a very secure sealing of the injection openings. To facilitate this effect and to enable good elastic deformability, a concave feature by which an elastic sealing lip is formed can be provided downstream of the first sealing region on the hollow valve needle. The second sealing region is embodied on the sealing lip and takes its seat on the valve seat before the first sealing region. The sealing lip is easily elastically deformable, which on the one hand assures good sealing and on the other does not cause excessive deformation or strains of the hollow valve needle.

DRAWING

Various exemplary embodiments of the fuel injection valve of the invention are shown in the drawing.

Figure 3:
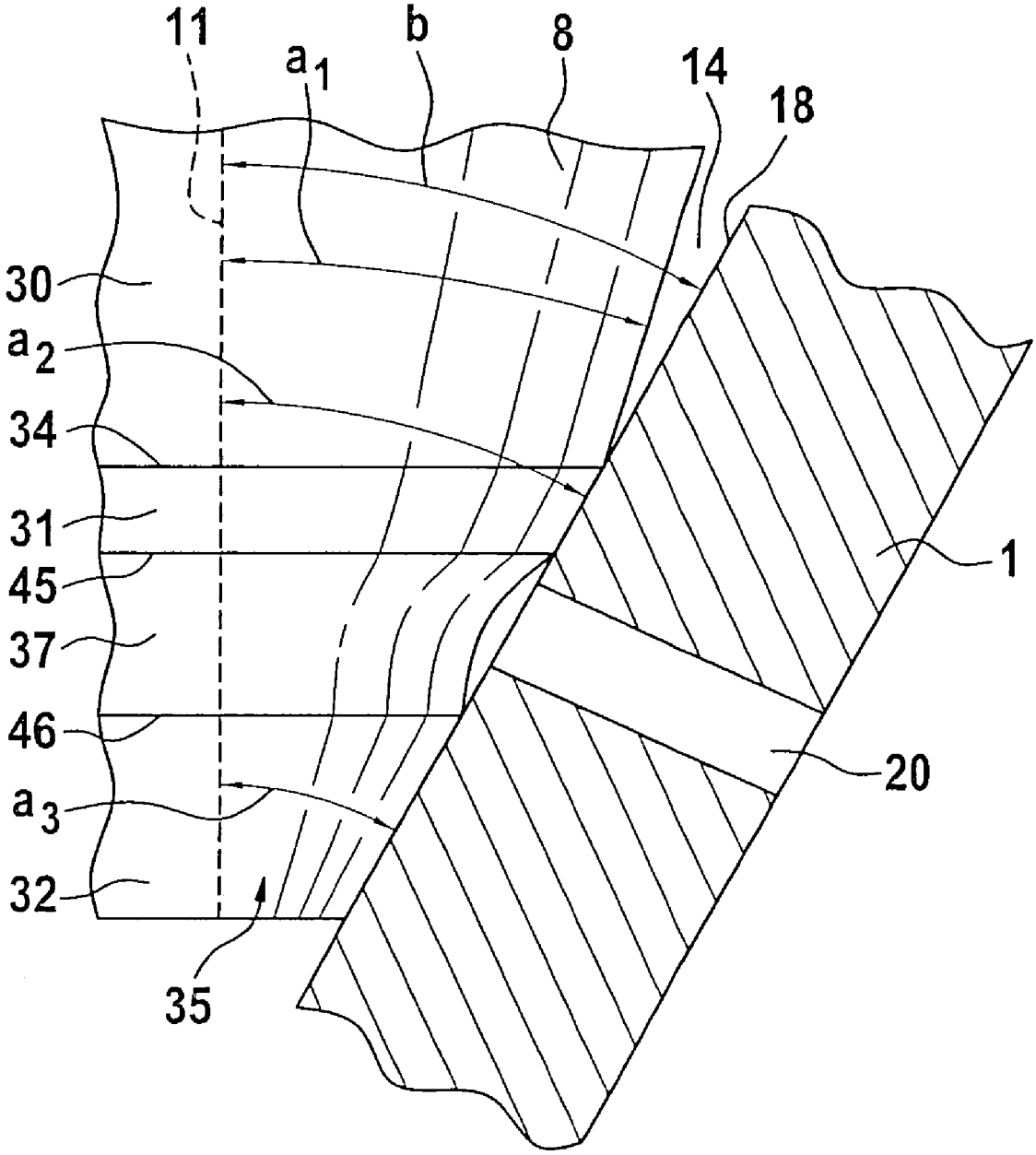
FIG. 3 is an enlargement of the detail marked III in FIG. 2.

FIG. 4, FIG. 5, FIG. 6, FIG. 7, and FIG. 8, each in the same view as FIG. 3, show further exemplary embodiments.

DESCRIPTION OF THE EXEMPLARY EMBODIMENT

Figure 1:
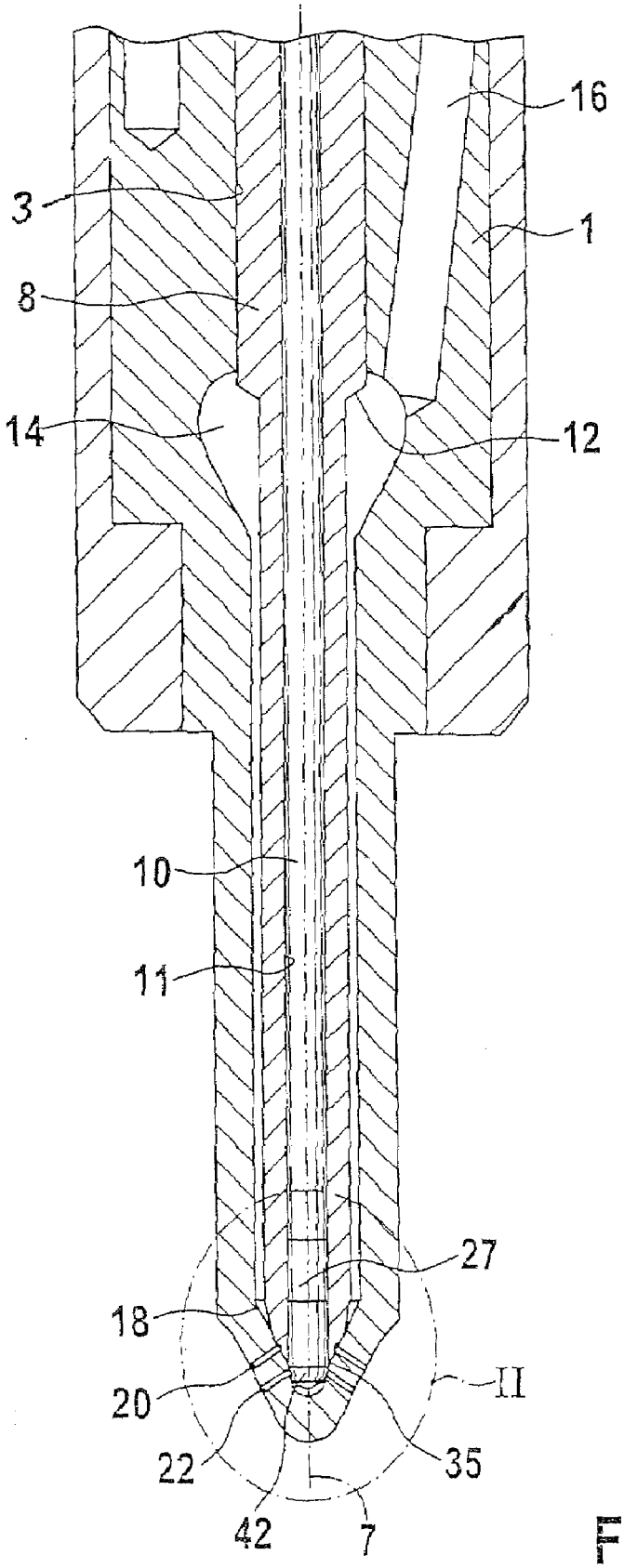
FIG. 1 shows a longitudinal section through a fuel injection valve of the invention.

In FIG. 1, a fuel injection valve is shown in longitudinal section. In a valve body 1, a bore 3 is embodied that is defined on its end toward the combustion chamber by a conical valve seat 18. External injection openings 20 and internal injection openings 22 originate at the valve seat 18 and are located at different levels relative to the longitudinal axis 7 of the bore 3. In general, a plurality of injection openings are provided over the circumference of the injection valve, with all the outer injection openings 20 and all the inner injection openings 22 located at the same level relative to the longitudinal axis 7 of the bore 3, forming two rows of injection openings. The injection openings 20, 22, in the installed position of the fuel injection valve, discharge into the combustion chamber of the engine.

A hollow valve needle 8 is located longitudinally displaceably in the bore 3 and is guided sealingly in a guide portion of the bore 3 facing away from the combustion chamber. Beginning at the guided portion, the hollow valve needle 8 tapers toward the valve seat 18, forming a pressure shoulder 12, and on its end toward the combustion chamber and the valve seat 18, it changes over into a valve sealing face 35, which is embodied substantially conically and by which the hollow valve needle 8 cooperates with the valve seat 18. A pressure chamber 14 is embodied between the hollow valve needle 8 and the wall of the bore 3 and is radially enlarged in a region adjoining the guide portion. An inlet conduit 16 extending within the valve body 1 discharges into the radial enlargement of the pressure chamber 14, and by way of this conduit the pressure chamber 14 can be filled with fuel at high pressure.

The hollow valve needle 18 has a longitudinal bore 11, which is embodied concentrically with the longitudinal axis of the hollow valve needle 18 and extends over the entire length thereof. In the longitudinal bore 11, a valve needle 10 is located longitudinally displaceably; on its end toward the combustion chamber, it has a valve sealing face 42, by which the valve needle 10 cooperates with the valve seat 18 for controlling the inner injection openings 22. In the longitudinal bore 11, the valve needle 10 is guided near the valve seat 18 in a guide portion 27, which is formed by a slight thickening of the valve needle 10. Both the hollow valve needle 8 and the valve needle 10 are subjected, on their end facing away from the combustion chamber, to a closing force that points in the direction of the valve seat 18 and that is generated for instance by one spring per needle, or by a hydraulic device.

Figure 2:
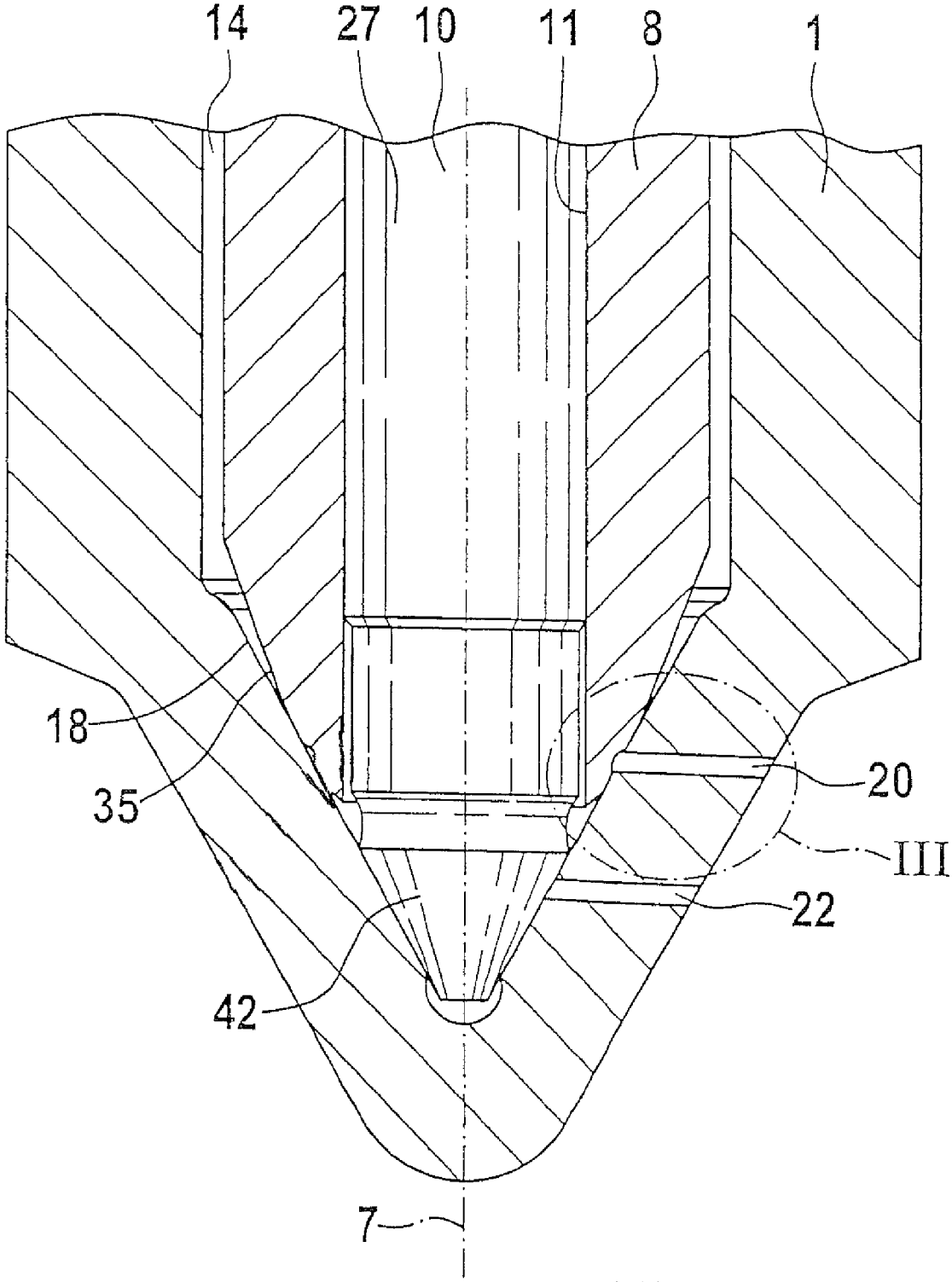
FIG. 2 is an enlargement of the detail marked II in FIG. 1.

FIG. 2 shows an enlargement of the detail marked 11 in FIG. 1. The hollow valve needle 8 cooperates with the valve seat 18 in such a way that upon contact of the hollow valve needle 8 with the valve seat 18, the outer injection openings 20 are closed. In a similar way, the valve needle 10 closes the inner injection openings 22 upon contact with the valve seat 18.

The function of the fuel injection valve is as follows: At the onset of the injection cycle, both the hollow valve needle 8, with its valve sealing face 35, and the valve needle 10, with its valve sealing face 42, are in contact with the valve seat 18. In the pressure chamber 14, a high fuel pressure already prevails, by which a hydraulic opening force on the pressure shoulder 12 of the hollow valve needle 8 is produced. If the injection is to begin, the closing force on the hollow valve needle 8 is reduced, so that now the hydraulic opening force predominates over the closing force. This produces a resultant force on the hollow valve needle 8 that moves it away from the valve seat 18. The outer injection openings 20 are thus uncovered, and fuel can flow out of the pressure chamber 14 between the valve sealing face 35 and the valve seat 18 to the outer injection openings 20 and is injected through them into the combustion chamber. Initially, the valve needle 10 remains in its closing position, in which the inner injection openings 22 are closed. Since until now, only some of the injection openings 20, 22 have been opened, the fuel is injected at a relatively low rate, which is required for instance for a preinjection. Once the hollow valve needle 8 lifts from the valve seat 18, the valve needle 10 is subjected to fuel pressure, so that a hydraulic opening force oriented counter to the corresponding closing force is also produced on the valve needle 10. As soon as the opening force predominates, the valve needle 10 also moves away from the valve seat 18, as a result of which the inner injection openings 22 are uncovered. Now fuel is injected through all the injection openings 20, 22 at a considerably higher rate, of the kind required for instance for the main injection.

Provision can also be made for the closing force on the hollow valve needle 8 to remain constant at all times. In that case, the fuel pressure in the pressure chamber 14 is not increased until before the onset of the injection, until the rising fuel pressure caused by the hydraulic forces on the hollow valve needle 8 predominates over the closing force. Alternatively, provision may be made for the valve needle 10 to remain closed as the result of a suitably strong closing force, and for the hollow valve needle 8 after opening to slide back into its closing position. Such an injection is for instance required for a preinjection or pilot injection that is chronologically separate from the main injection.

FIG. 3 shows an enlarged detail of the hollow valve needle 8 in the region of the valve sealing face 35, this being the detail marked III in FIG. 2. The valve sealing face 35 has a first conical face 30, a second conical face 31, and a third conical face 32, which are embodied in that order in the downstream direction on the valve sealing face 35. The first conical face 30 is directly adjacent the second conical face 31, so that an edge 34 is embodied at the transition. The opening angle $a_1$ of the first conical face 30 is smaller than the opening angle $a_2$ of the second conical face 31. The opening angle $a_3$ of the third conical face 32 is equal to that of the second conical face 31, and both conical faces 31, 32 are located on a common imaginary conical surface. Between the second conical face 31 and the third conical face 32, an annular groove 37 is embodied, whose upstream edge 45 and downstream edge 46, upon contact of the valve sealing face 35 with the valve seat 18, are located upstream and downstream, respectively, of the outer injection openings 20. The valve seat 18 is likewise embodied conically and has an opening angle b, which is equal to the opening angle $a_2$ of the second conical face 31 and the opening angle $a_3$ of the third conical face 32. As a result, in the closing position of the hollow valve needle 8, both the second conical face 31, which forms the first sealing region, and the third conical face 32, which forms the second sealing region, come into contact with the valve seat 18, so that the outer injection openings 20 are sealed off from the pressure chamber 14 and downstream in the direction of the inner injection openings 22. Since the annular groove 37 is embodied as relatively shallow, and the two sealing regions of the valve needle 8 seal off the annular groove 37 adequately, only a slight fuel volume that can reach the combustion chamber when the fuel injection valve is closed is produced via the outer injection openings 20.

Figure 4:
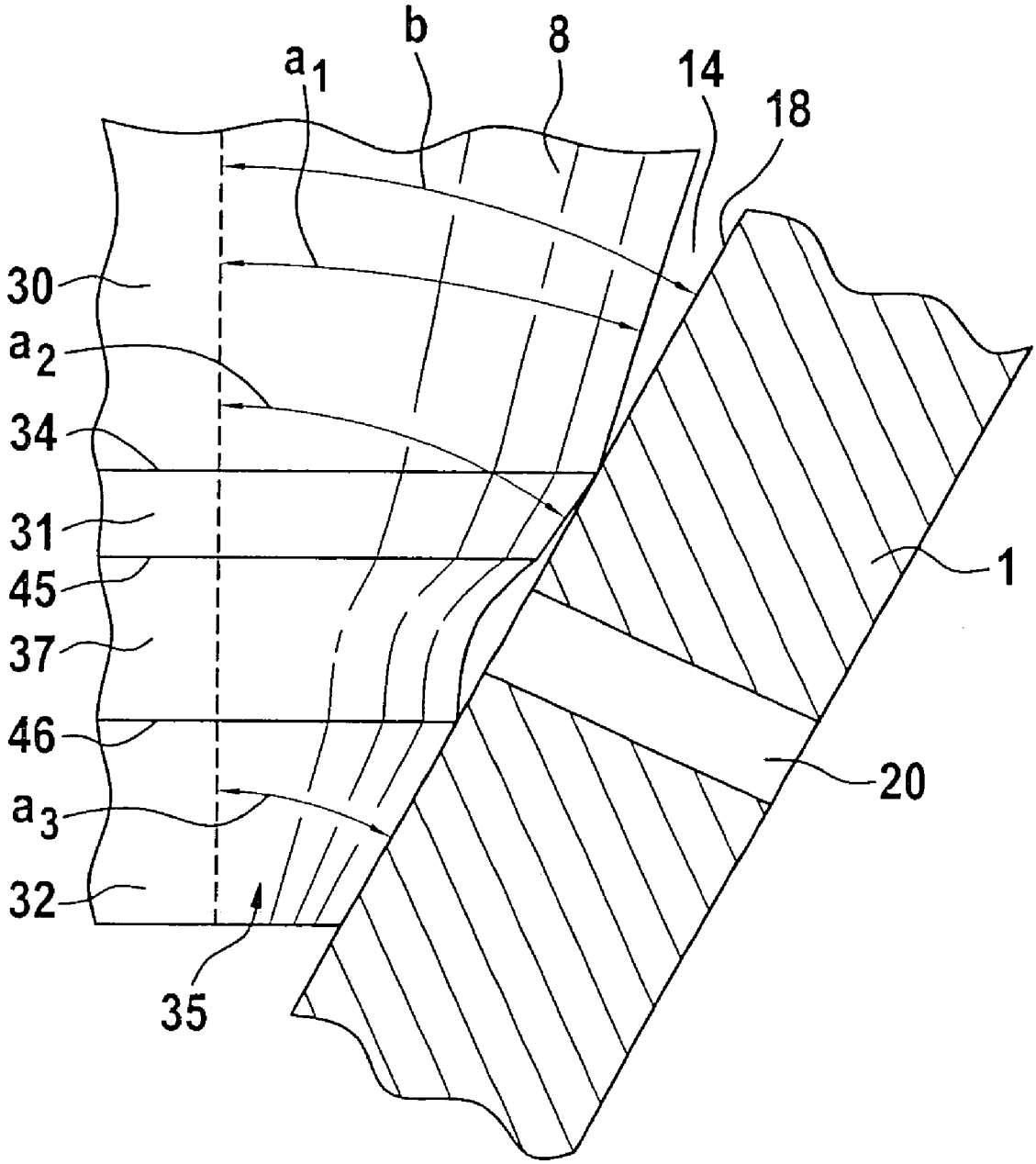

FIG. 4 shows the same view as FIG. 3 for a further exemplary embodiment. Here, however, the second conical face 31 has an opening angle $a_2$ that is greater than the opening angle b of the conical valve seat 18. As a result, the edge 34, located at the transition from the first conical face 30 to the second conical face 31, is embodied as a sealing edge and forms the first sealing region. The third conical face 32 is unchanged from the exemplary embodiment shown in FIG. 3.

The edge 34 and the third conical face 32, that is, the two sealing regions, are located relative to the valve seat 18 in such a way that when the fuel injection valve is new, the edge 34 rests on the valve seat 18 first, while the third conical face 32 is still spaced apart from the valve seat 18, but only by a very narrow gap, which produces adequate but not complete sealing. In operation, the edge 34 is hammered into the valve seat 18 somewhat until the third conical face 32, in the closing position of the hollow valve needle 8, rests on the valve seat 18, so that sealing with high pressure per unit of surface area thus results in both sealing regions, thus producing good sealing in the first sealing region, which seals off from the high pressure of the pressure chamber. However, provision may also be made that in the new fuel injection valve both sealing regions are oriented in such a way that the hollow valve needle 8 first becomes seated on the valve seat 18 with the second sealing region, that is, the third conical face 32. By the cooperation with the valve seat 18, the hollow valve needle is deformed elastically inward somewhat in the region of the third conical face 32, to an extent such that the edge 34 is seated on the valve seat 18. Thus once again suitable sealing both upstream and downstream of the outer injection openings 20 is produced.

Figure 5:
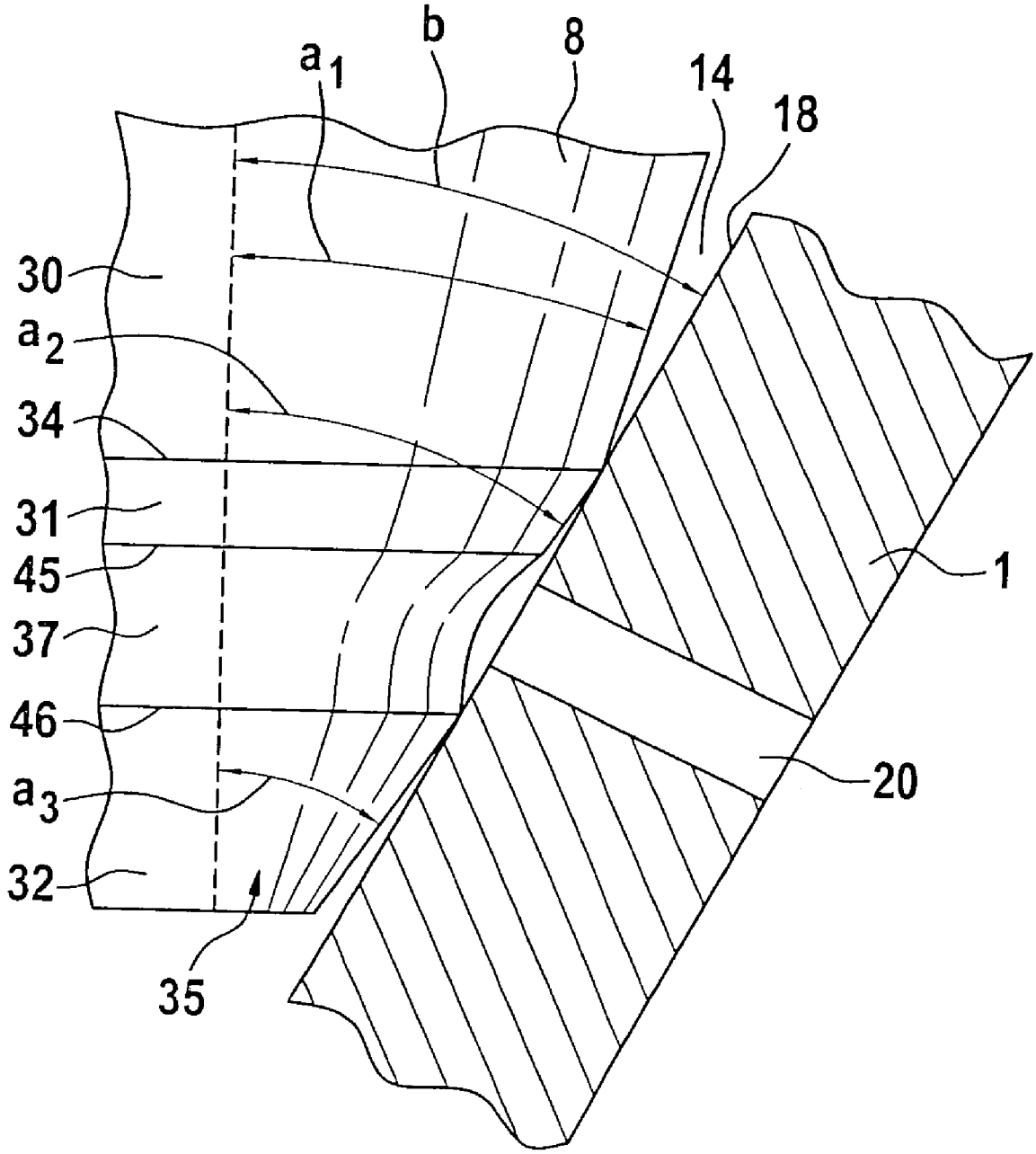

A further exemplary embodiment is shown in FIG. 5, in the same view as in FIG. 3. Here, both the opening angle $a_2$ of the second conical face 31 and the opening angle $a_3$ of the third conical face 32 are larger than the opening angle b of the conical valve seat 18. The downstream edge 46 of the annular groove 37 here forms the second sealing region, which relative to the first sealing region, that is, the edge 34, is embodied such that either the first or the second sealing region comes to rest first on the valve seat 18. If the first sealing region, that is, the edge 34, comes to rest first, then the complete sealing at the second sealing region comes about only in operation, in which the edge 34 is hammered somewhat into the valve seat 18 until the downstream edge 46 of the annular groove 37 rests on the valve seat 18. Conversely, if the second sealing region, that is, the downstream edge 46, comes to rest on the valve seat 18 first, then the first sealing region, as in the exemplary embodiment shown in FIG. 4 and described above, provides sealing when the hollow valve needle 18 becomes deformed elastically inward at its tip.

Figure 6:
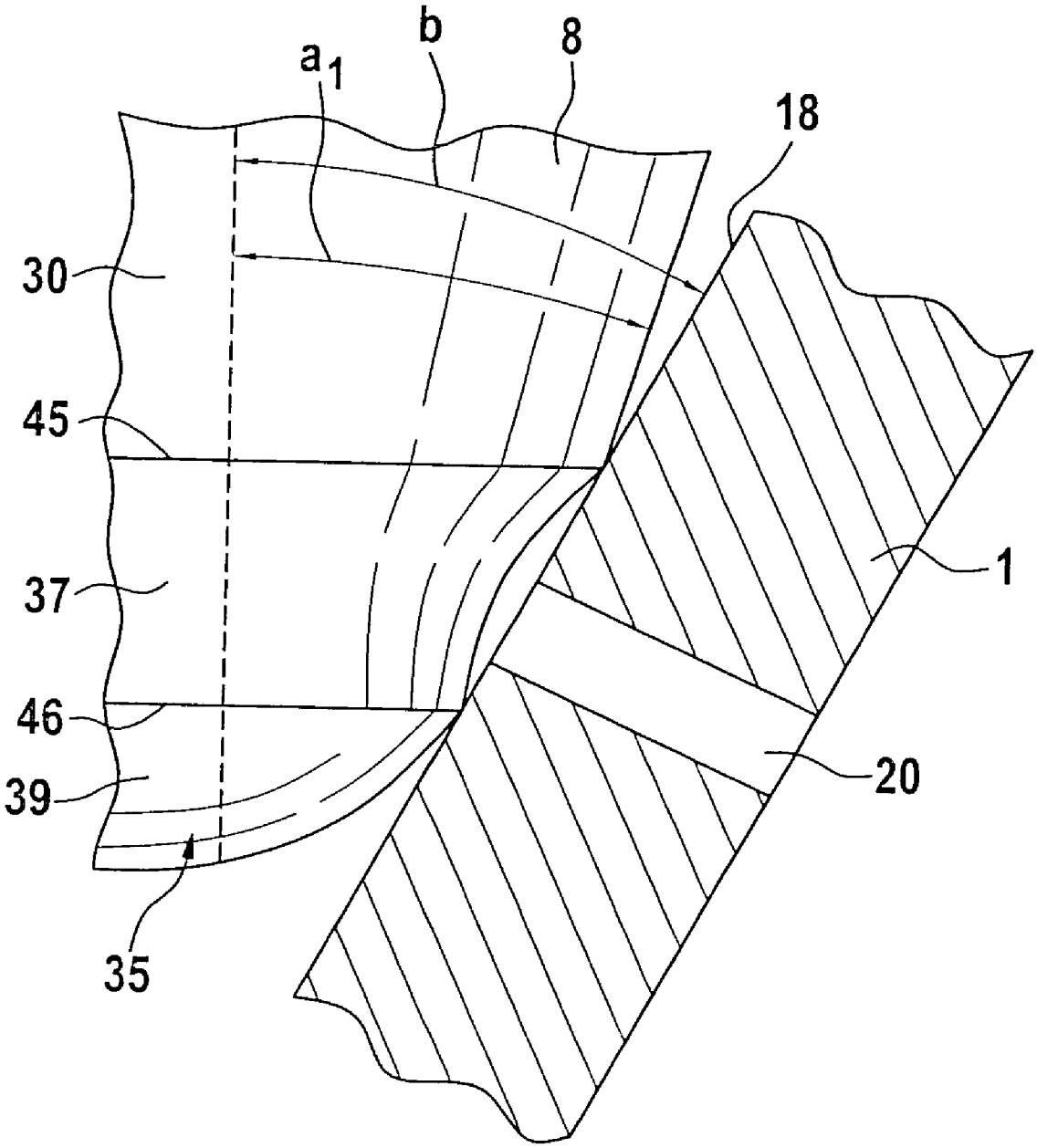

FIG. 6 shows a further exemplary embodiment in the same view as in FIG. 5. The opening angle a1 of the first conical face 30 is smaller than the opening angle b of the conical valve seat 18, so that an upstream edge 45 that forms the first sealing region is formed at the transition from the first conical face 30 to the annular groove 37. The downstream edge 46 of the annular groove 37 is embodied as a second sealing region, which is adjoined by a convex end portion 39. The cooperation between the upstream edge 45 and the downstream edge 46 of the annular groove 37 is analogous to the exemplary embodiment of FIG. 5. Accordingly, it can be provided either that the upstream edge 45 rests on the valve seat 18 before the downstream edge 46, or vice versa.

Figure 7:
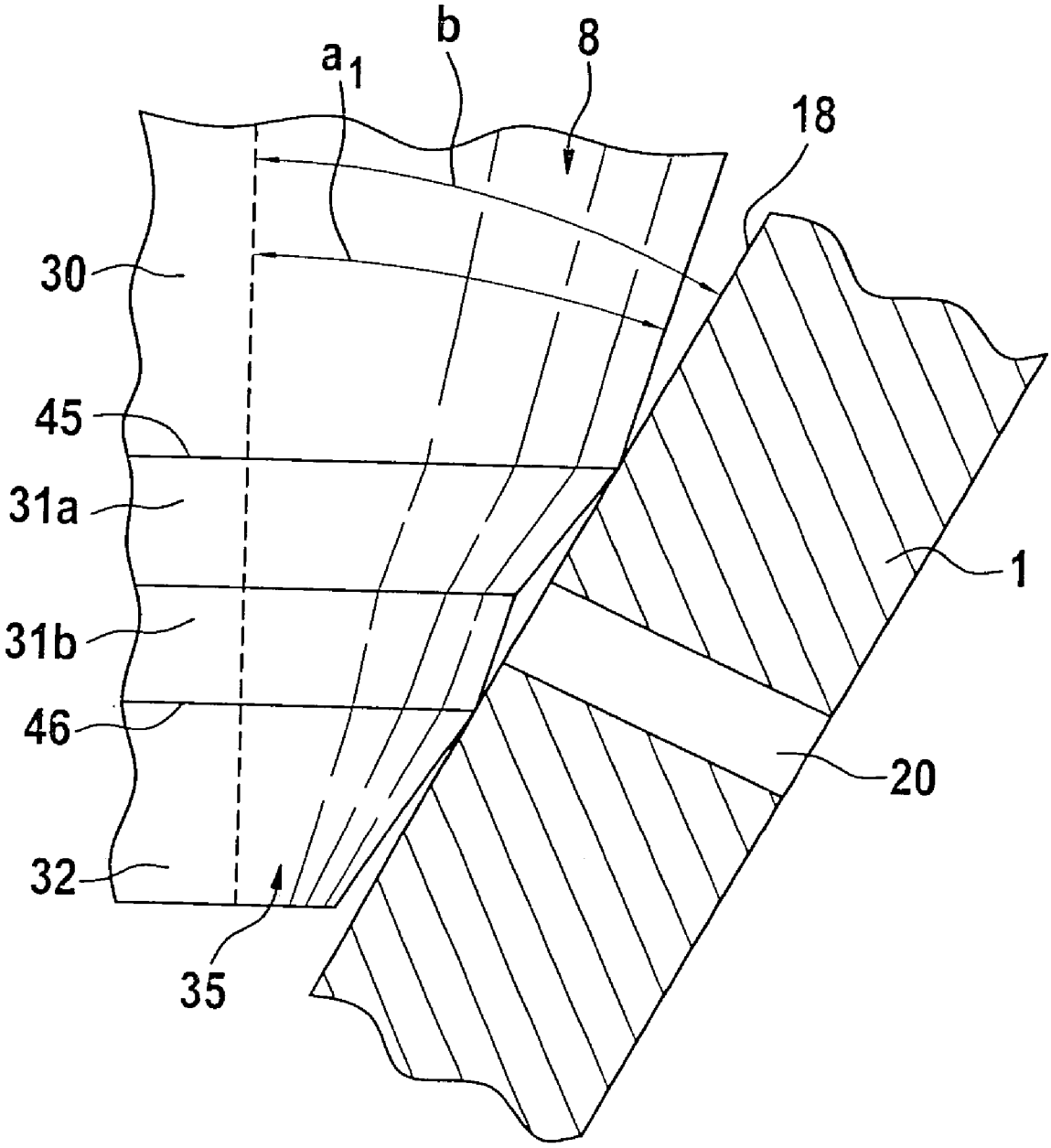

A further exemplary embodiment is shown in FIG. 7. Besides the first conical face 30 and the third conical face 32, which are located identically to the conical faces in FIG. 5, the valve needle 8 has, instead of an annular groove, an upper conical face 31*a* and a lower conical face 31*b*. At the transition from the first conical face 30 to the upper conical face 31*a*, the first sealing region is embodied, in the form of an upstream edge 45, and correspondingly, a downstream edge 46 that forms the second sealing region is embodied at the transition from the lower conical face 31*b* to the third conical face 32. The advantage of this arrangement is its ease of manufacture, since all the conical faces on the valve needle 8 can be ground with the same tools. The sealing functions at the first and second sealing regions are analogous to the exemplary embodiment shown in FIG. 5.

Figure 8:
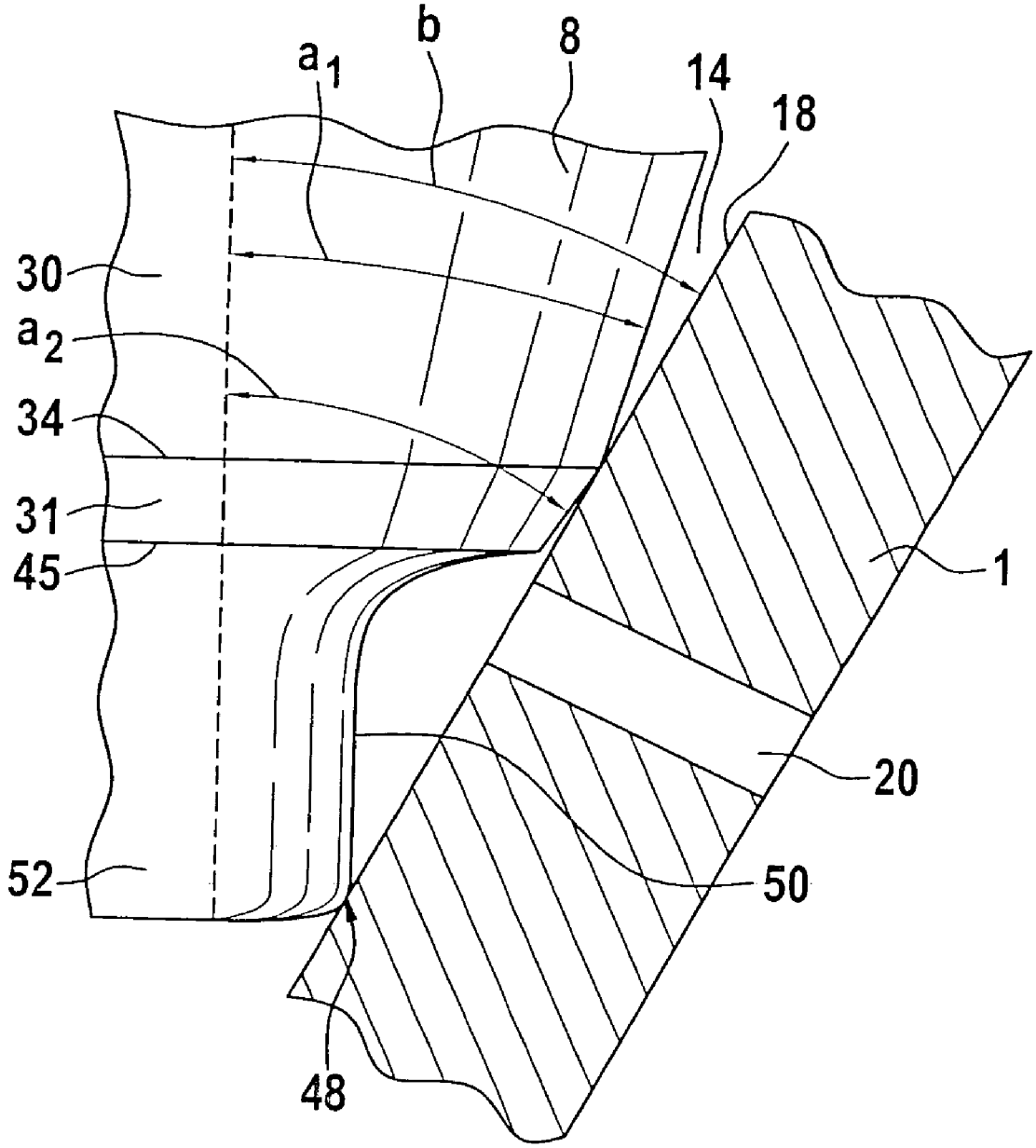

The sealing at both sealing regions by elastic deformation of the hollow valve needle 8 is also the principle in the exemplary embodiment shown in FIG. 8, in which the identical parts of the hollow valve needle are identified by the same reference numerals as in FIGS. 3, 4, and 5. Here, instead of the annular groove 37 and the third conical face 32, a concave feature 50 is provided, by which a sealing lip 52 is formed. A sealing edge 48 that forms the second sealing region is provided on the sealing lip 52. As a result of the concave feature, the sealing lip 52 is embodied as relatively thin, resulting in good elastic deformability. As already noted above, the sealing principle is due to the fact that in the closing motion of the hollow valve needle 8, the sealing edge 48 takes its seat on the conical valve seat 18 first. As a result of the contact pressure of the hollow valve needle 8 against the valve seat 18, the sealing lip 52 is deformed elastically inward, until the edge 34, which analogously to the exemplary embodiment shown in FIG. 5 is embodied between the first conical face 30 and the second conical face 31, takes its seat on the valve seat 18.

The invention claimed is:

1. A fuel injection valve for internal combustion engines, having a valve body in which a bore is embodied that is defined on its end toward the combustion chamber by a valve seat at which at least one injection opening originates, and having a hollow valve needle, which is located longitudinally displaceably in the bore and which has a valve sealing face on its end oriented toward the valve seat, wherein a first sealing region and a second sealing region are embodied on the valve sealing face, and the hollow valve needle cooperates with the valve seat in such a way that upon contact of the hollow valve needle with the valve seat, the first sealing region upstream of the at least one injection opening and the second sealing region downstream of that injection opening effect sealing between the valve sealing face and the valve seat, wherein the valve sealing face has a first conical face, a second conical face located downstream of the first conical face, and a third conical face located downstream of the second conical face, wherein the first conical face has a smaller opening angle than the second conical face, so that at the boundary line between the conical faces, the first sealing region is embodied as an edge extending all the way around.

2. A fuel injection valve for internal combustion engines, having a valve body in which a bore is embodied that is defined on its end toward the combustion chamber by a conical valve seat at which at least one injection opening originates, and having a hollow valve needle, which is located longitudinally displaceably in the bore and which has a valve sealing face on its end oriented toward the valve seat, wherein a first sealing region and a second sealing region are embodied on the valve sealing face, and the hollow valve needle cooperates with the valve seat in such a way that upon contact of the hollow valve needle with the valve seat, the first sealing region upstream of the at least one injection opening and the second sealing region downstream of that injection opening effect sealing between the valve sealing face and the valve seat, wherein the valve sealing face has a first conical face, a second conical face located downstream of the first conical face, and a third conical face located downstream of the second conical face, wherein the third conical face has a larger opening angle than the conical valve seat.

3. A fuel injection valve for internal combustion engines, having a valve body in which a bore is embodied that is defined on its end toward the combustion chamber by a valve seat at which at least one injection opening originates, and having a hollow valve needle, which is located longitudinally displaceably in the bore and which has a valve sealing face on its end oriented toward the valve seat, wherein a first sealing region and a second sealing region are embodied on the valve sealing face, and the hollow valve needle cooperates with the valve seat in such a way that upon contact of the hollow valve needle with the valve seat, the first sealing region upstream of the at least one injection opening and the second sealing region downstream of that injection opening effect sealing between the valve sealing face and the valve seat, wherein the valve sealing face has a first conical face, a second conical face located downstream of the first conical face, and a third conical face located downstream of the second conical face, wherein an annular groove that covers the injection opening is formed between the second conical face and the third conical face.

* * * * *